United States Patent [19]

Merkelo

[11] 4,069,418

[45] Jan. 17, 1978

[54] DETACHABLE HIGH-SPEED OPTOELECTRONIC SAMPLING HEAD

[75] Inventor: Henry Merkelo, Urbana, Ill.

[73] Assignee: The University of Illinois Foundation, Urbana, Ill.

[21] Appl. No.: 663,283

[22] Filed: Mar. 2, 1976

[51] Int. Cl.[2] ..... H01J 39/00; H01J 39/12

[52] U.S. Cl. ..... 250/207; 250/211 R; 313/95

[58] Field of Search ..... 250/239, 207, 211 R; 313/95, 99

[56] References Cited

U.S. PATENT DOCUMENTS

| | | | |
|---|---|---|---|
| 3,478,213 | 11/1969 | Simon et al. | 250/207 |
| 3,483,421 | 12/1969 | Hogan | 250/211 R |
| 3,941,998 | 3/1976 | Merkelo | 250/207 |

*Primary Examiner*—Alfred E. Smith
*Assistant Examiner*—David K. Moore
*Attorney, Agent, or Firm*—Daniel M. Rosen

[57] ABSTRACT

A detachable high-speed optoelectronic sampling head for use with an electron multiplier includes a housing having an evacuated chamber with a pair of transparent windows. Light to be detected is directed to the first window to a photoemissive strip spaced from a ground plane. The photoemissive strip comprises a microstrip, and the housing has high frequency feedthrough means for applying sampling potentials between said photoemissive strip and ground plane. A phosphor layer is provided on the other window in the chamber, and photoelectrons emitted from the photoemissive strip are directed through the ground plane to the phosphor layer.

11 Claims, 31 Drawing Figures

Fig. 1.
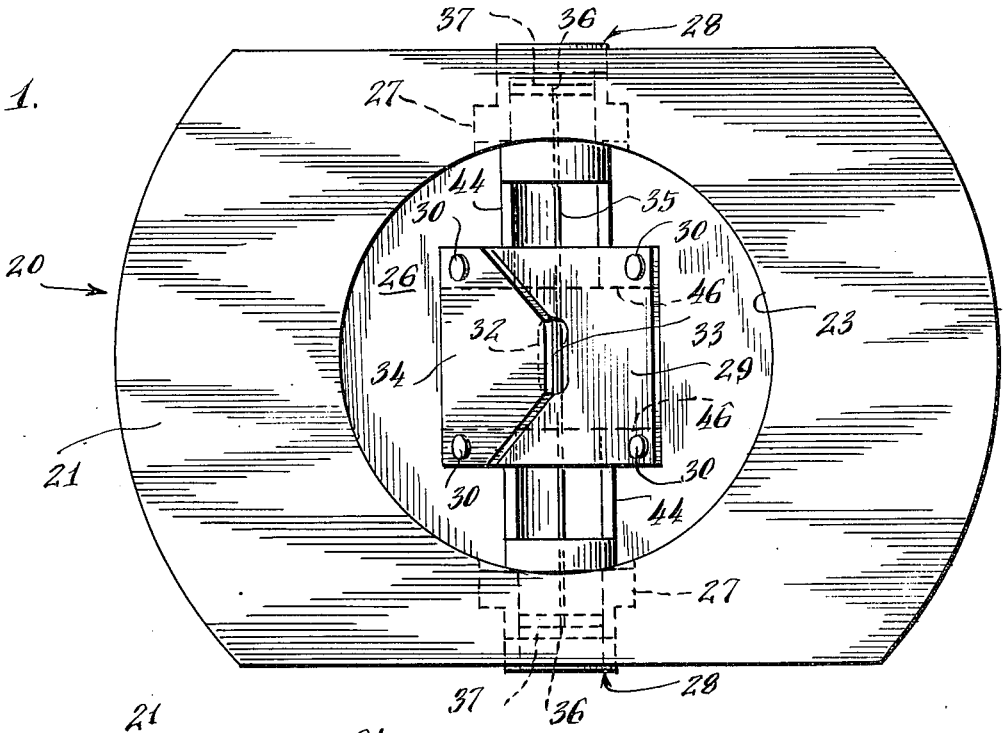
Fig. 2.
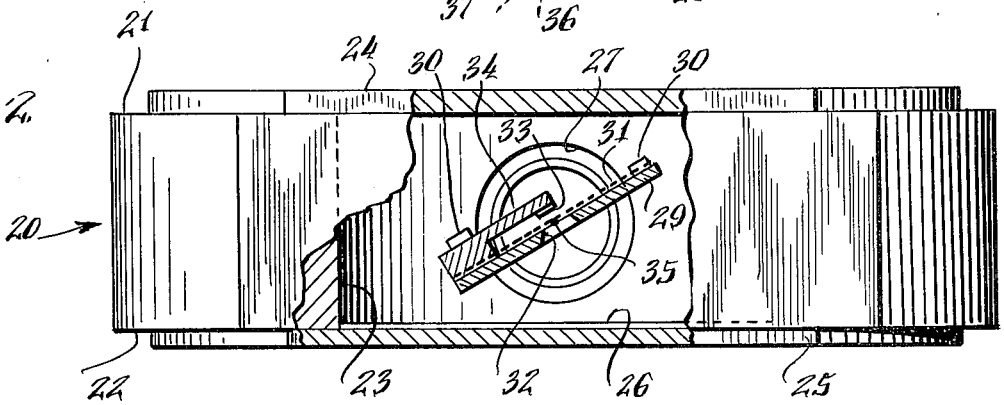
Fig. 5.
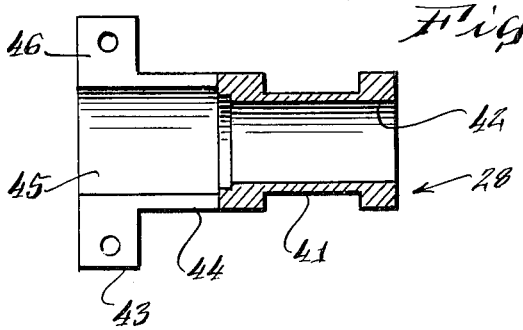
Fig. 3.
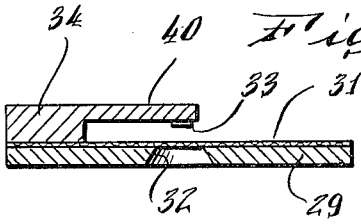
Fig. 4.
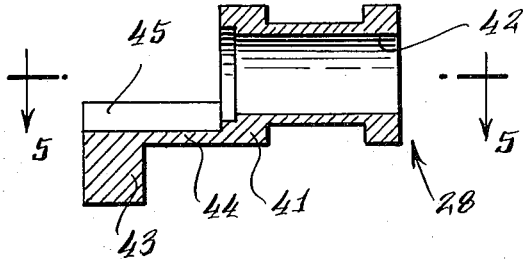
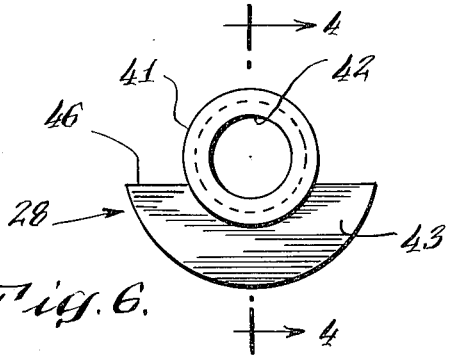
Fig. 6.

Fig. 7.
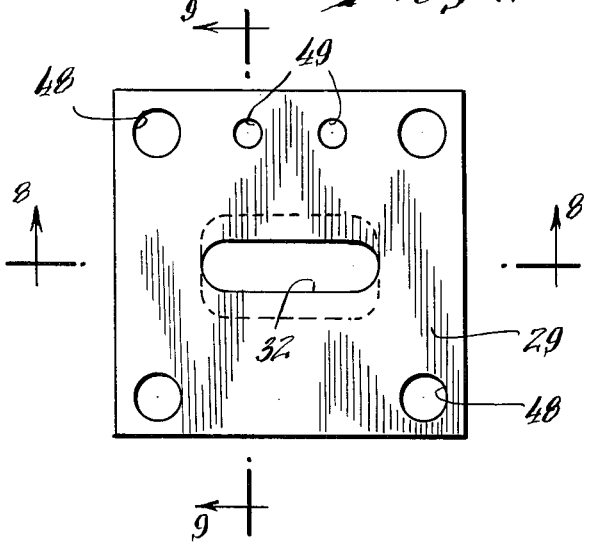
Fig. 9.
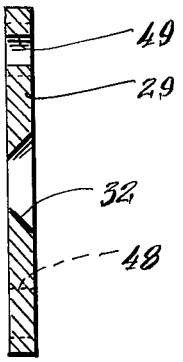
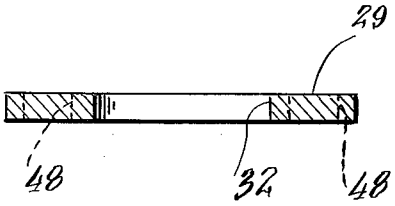
Fig. 8.
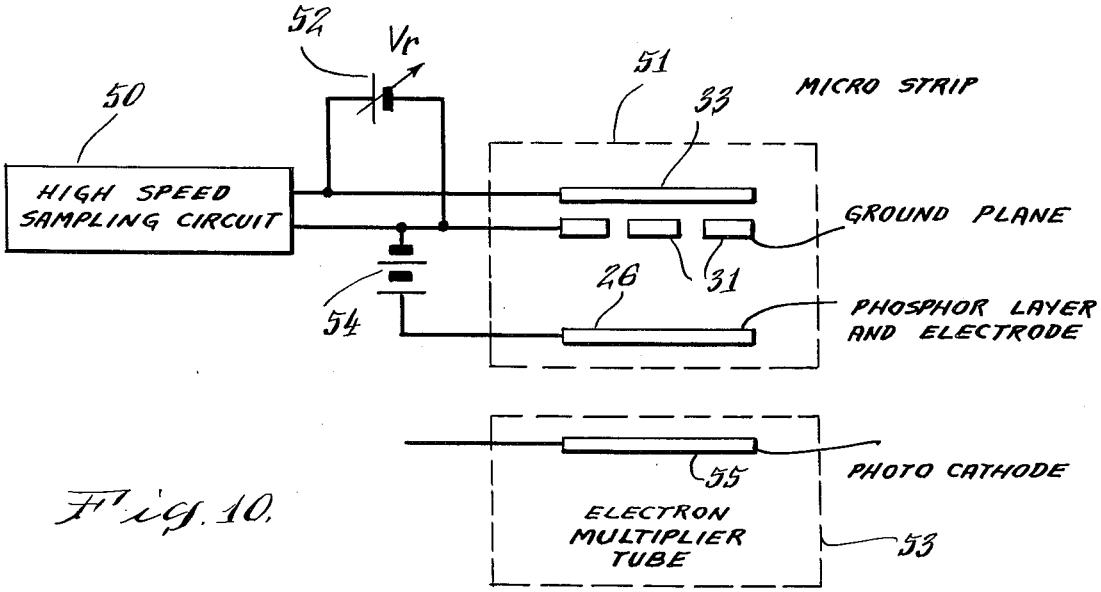
Fig. 10.

T (PICOSECONDS)
$V_A$ (VOLTS)
$\eta$
□-E
+-F
$\Delta x - 10^{-4}$
$\lambda = 4047$ Å
$\lambda = 5461$ Å
$\lambda = 6200$ Å

T (PICOSECONDS)
$V_A$ (VOLTS)
$\Delta x - 50\,\mu$
$\lambda = 4047\,\text{Å}$
$\lambda = 5461\,\text{Å}$
$\lambda = 6200\,\text{Å}$
$\eta$
□-E
+-F

DETACHABLE HIGH-SPEED OPTOELECTRONIC SAMPLING HEAD

The government has rights in this invention, pursuant to grant number GB-43287, awarded by The National Science Foundation.

THE INVENTION

This invention relates to optical detection devices, and is particularly directed to the provision of an optical sampling head that may be employed with a photoelectron amplifying device for the detection of rapidly varying, low power radiation.

Conventional photomultipliers do not possess adequate resolution nor speed to enable rapid sampling of optical signals, and electronic sampling is difficult to achieve in conventional gridded multiplier structures. My copending patent application Ser. No. 446,051, filed Feb. 26, 1974, now U.S. Pat. No. 3,941,998 discloses an optoelectronic sampling head which may be employed in combination with an electron multiplier, the sampling head incorporating microstrip elements in order to enable high frequency sampling. The present invention is directed to a sampling head of the type of my above application, which can be externally appended to a conventional multiplier such that the time resolution of the device is improved by virtue of the attachment, and such that picosecond time resolution of optical signals can be achieved with ordinary phototubes. In other words, the present invention is directed to the provision of a high speed optoelectronic sampling head that may be employed in combination with, and is detachable from a conventional phototube, and enables the time resolution of signals by the ordinary phototube in a range which was not heretofore possible.

Briefly stated, in accordance with the invention, the optoelectronic sampling head in accordance with the invention is comprised of a housing having a pair of windows and defining an evacuated chamber. A photoemissive strip is mounted in the chamber and positioned to receive light to be detected from one of the windows. A ground plane is mounted in the chamber spaced from the photoemissive strip, whereby the photoemissive strip comprises a microstrip, and the ground plane comprises a microwave ground plane for the microstrip. A high frequency or broad band feedthrough is provided in the wall of the housing, in order to enable the application of high speed sampling potentials between the photoemissive strip and the ground plane, so that these sampling potentials propagate between the photoemissive strip and the ground plane. A phosphor layer is provided on the other window, in the chamber, and the photoemissive strip is positioned to direct photoelectrons emitted therefrom through the ground plane to the phosphor layer, so that phosphorescent light emitted by the phosphor layer may pass through the window to the photocathode of an electron multiplier tube positioned adjacent to the other window.

The phosphor layer of the sampling head is selected to have a phosphorescence time constant corresponding to the desired display frequency range. As a consequence, it is not necessary for this phosphor screen to be adapted to detection in the high frequency range of the sampler. It only need to be adequate for the display rate.

In order that the invention will be more clearly understood, it will not be disclosed in greater detail with reference to the accompanying drawings, wherein:

FIG. 1 is a top view of one embodiment of the detachable high speed optoelectronic sampling head in accordance with the invention, with the top window removed in order to clarify the construction of the device;

FIG. 2 is a side view of the sampling head of FIG. 1;

FIG. 3 is a cross-sectional view of the microstrip structure in the sampling head of FIG. 1;

FIG. 4 is a cross-sectional side view of a feedthrough adapter for the sampling head of FIG. 1;

FIG. 5 is a cross-sectional view in a plane at right angles to the view of FIG. 4, of the feedthrough adapter of FIG. 4;

FIG. 6 is an end view of the feedthrough adapter of FIG. 4;

FIG. 7 is a top view of the ground plane support for the sampling head of FIG. 1;

FIG. 8 is a cross-sectional view of the plate of FIG. 7 taken along the lines VIII — VIII;

FIG. 9 is a cross-sectional view of the plate of FIG. 7 taken along the lines IX — IX;

FIG. 10 is a simplified illustration of the manner of operation of the sampling head of the invention in combination with a conventional photomultiplier tube;

Figures 11A, 11B, 11C:
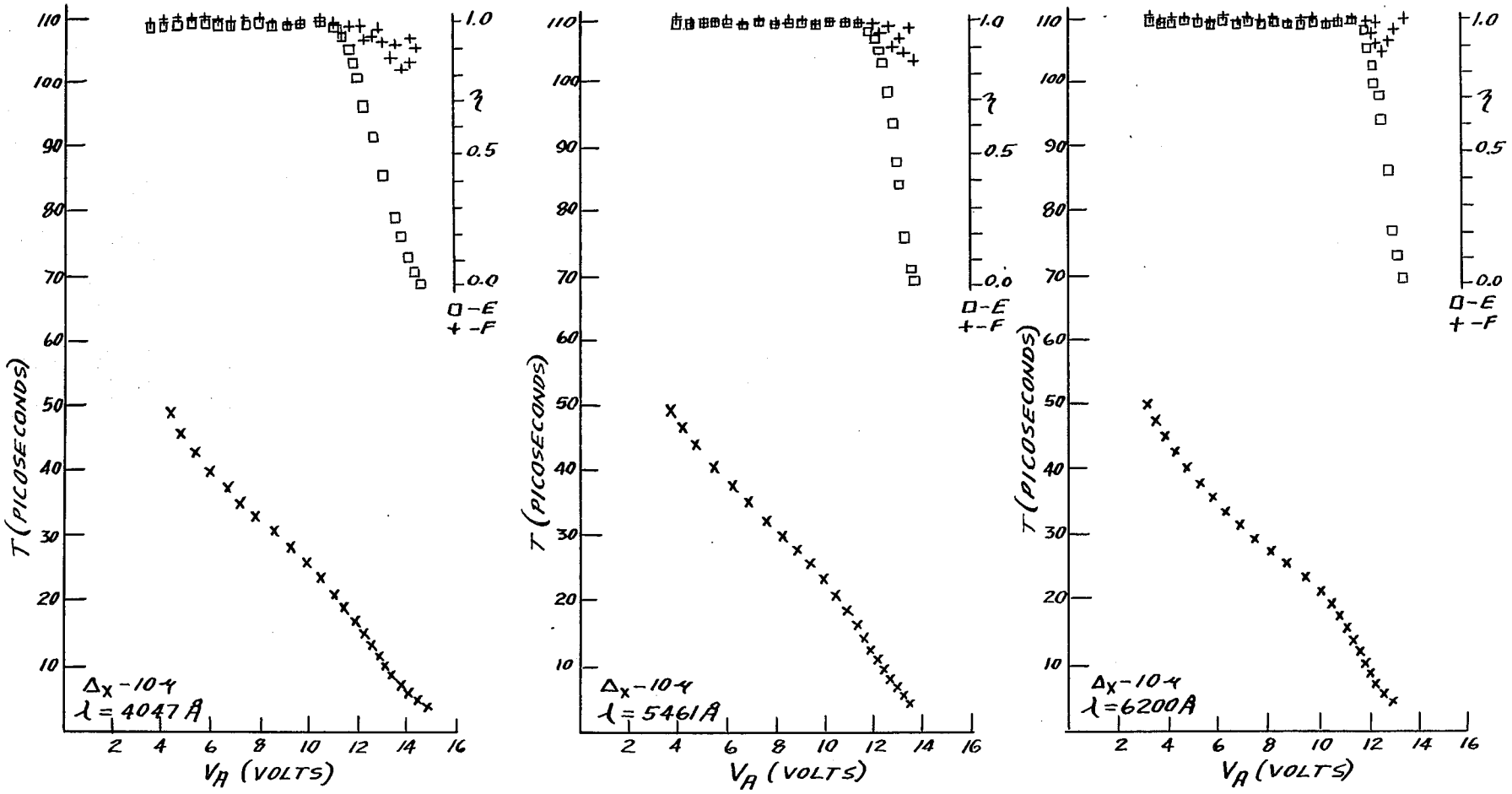
FIGS. 11A–11C are curves showing the resolution time and efficiency of the device of FIG. 1, for a drift space $\Delta_x$ of 10 microns, and at operating wavelengths of 4047, 5461 and 6200 angstrom units, respectively.
Figures 12A, 12B, 12C:
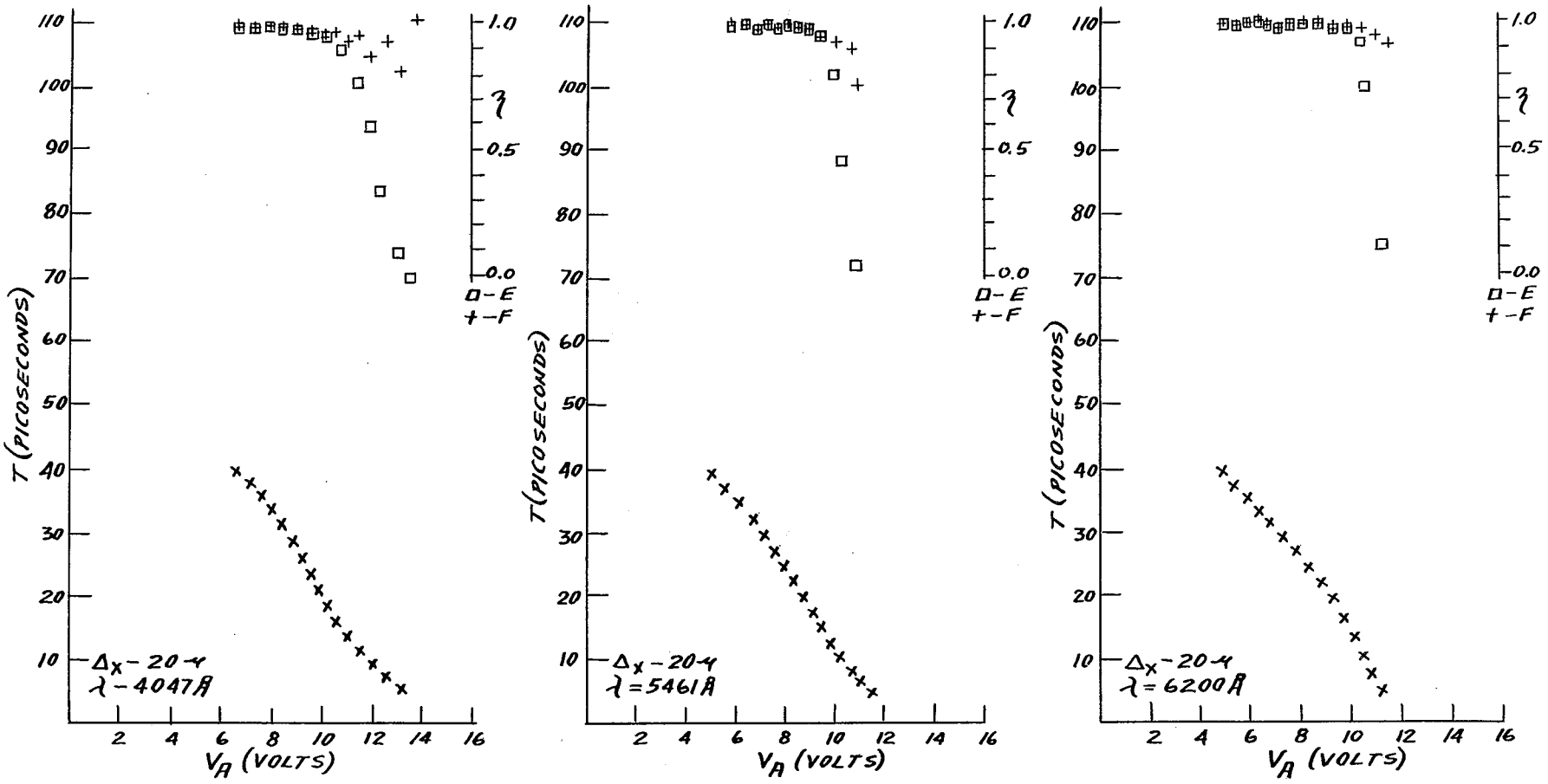
FIGS. 12A–12C are curves corresponding to the curves of FIGS. 11A–11C, for a drift space of 20 microns.
Figures 13A, 13B, 13C:
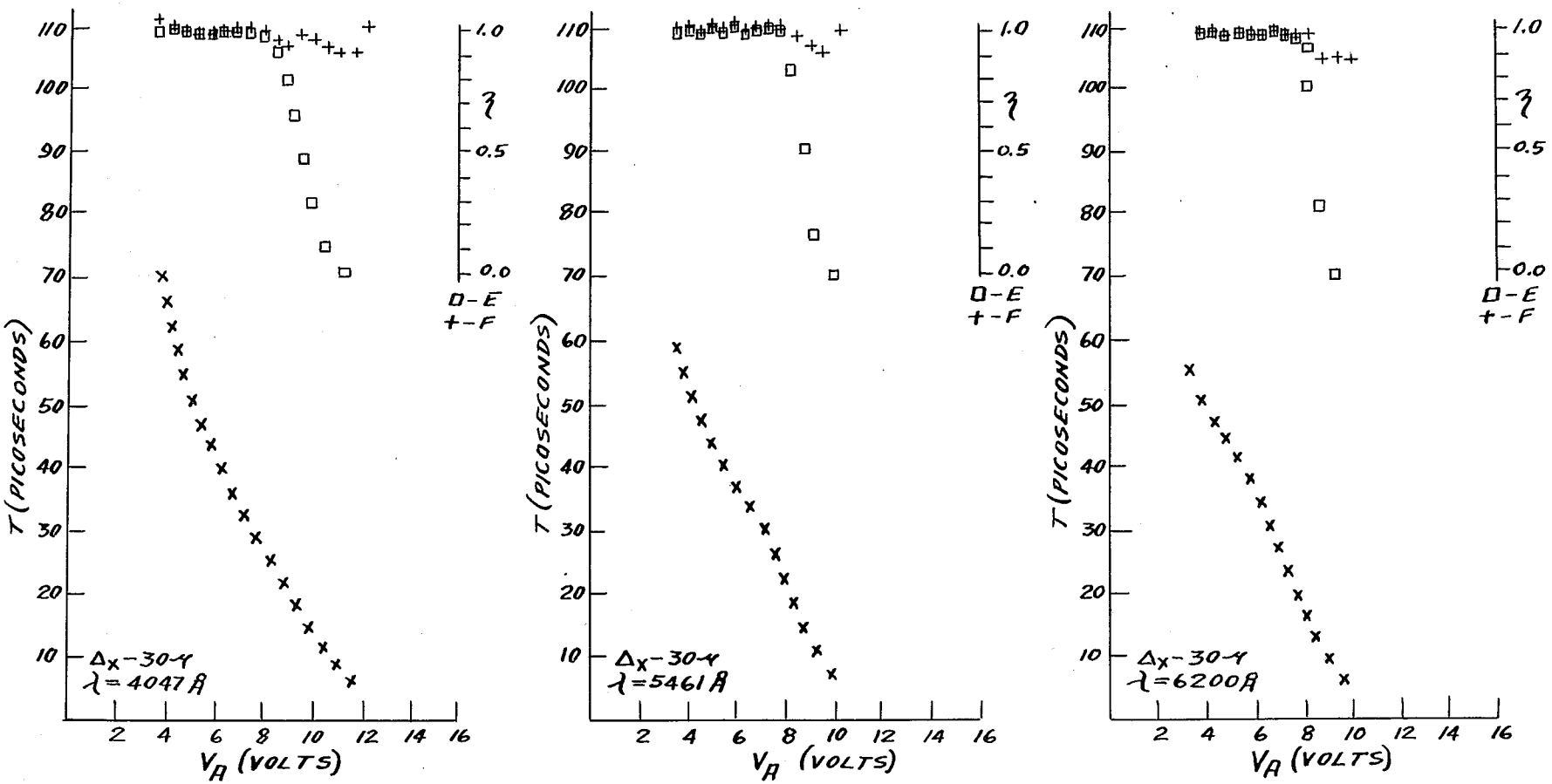
Figures 14A, 14B, 14C:
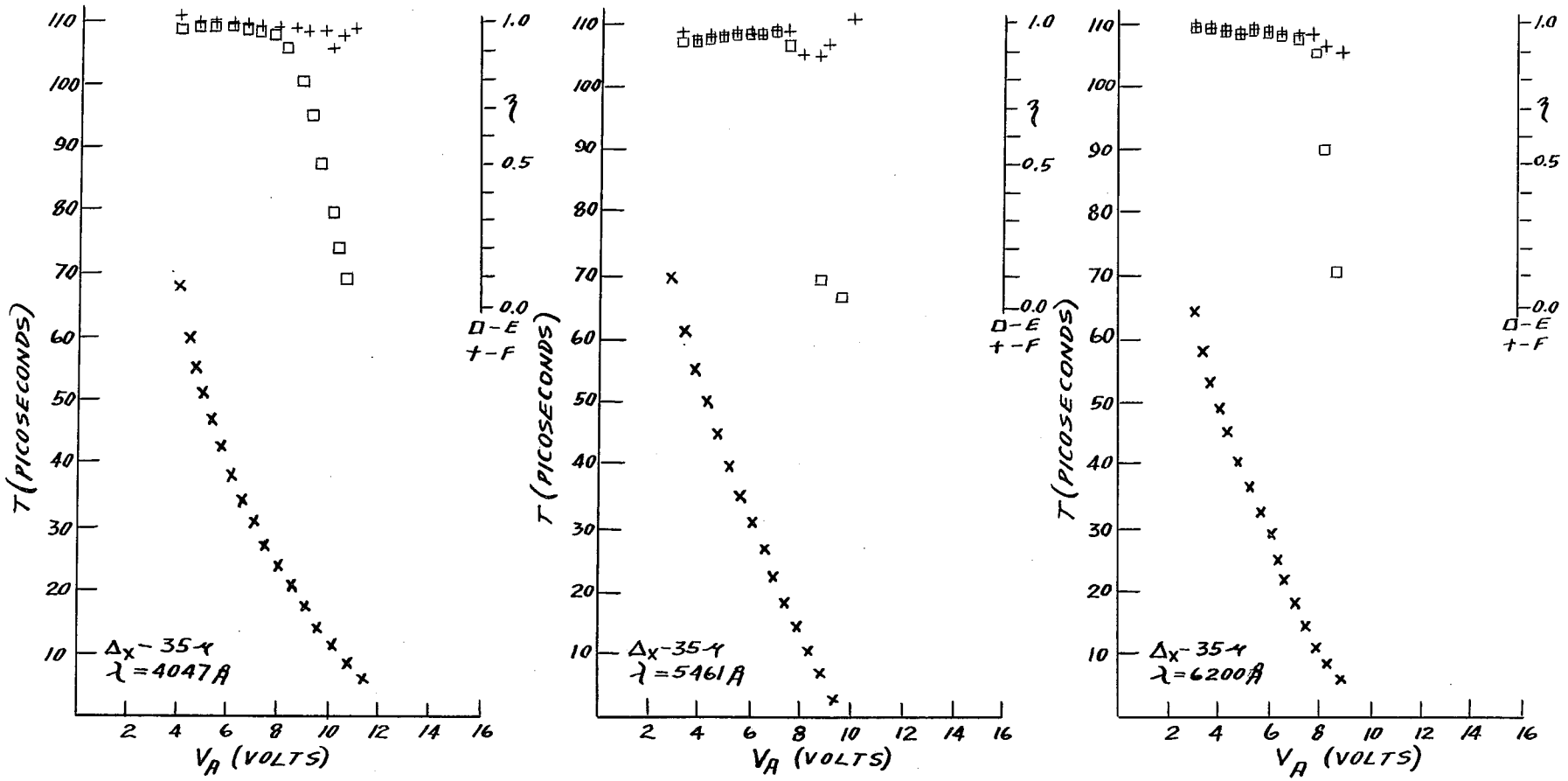
Figure 15C:
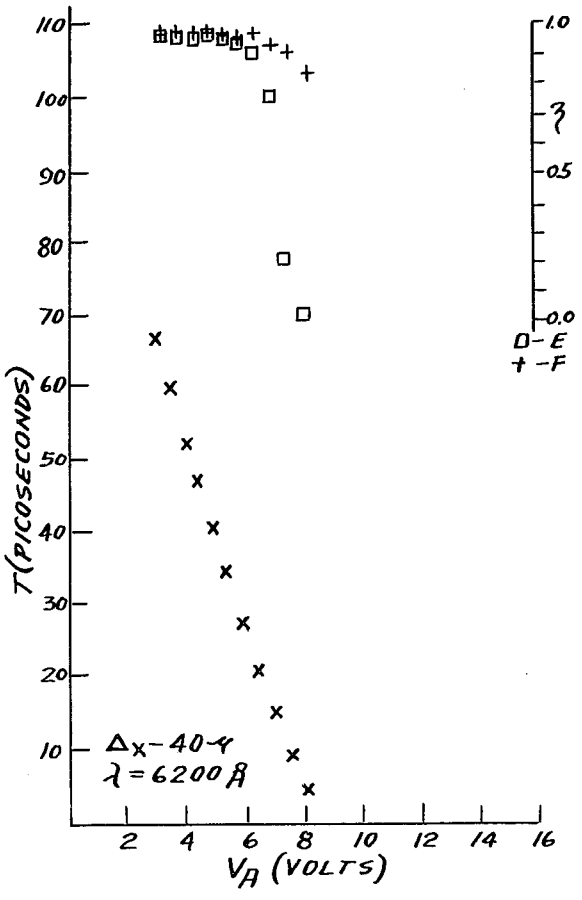
Figure 15B:
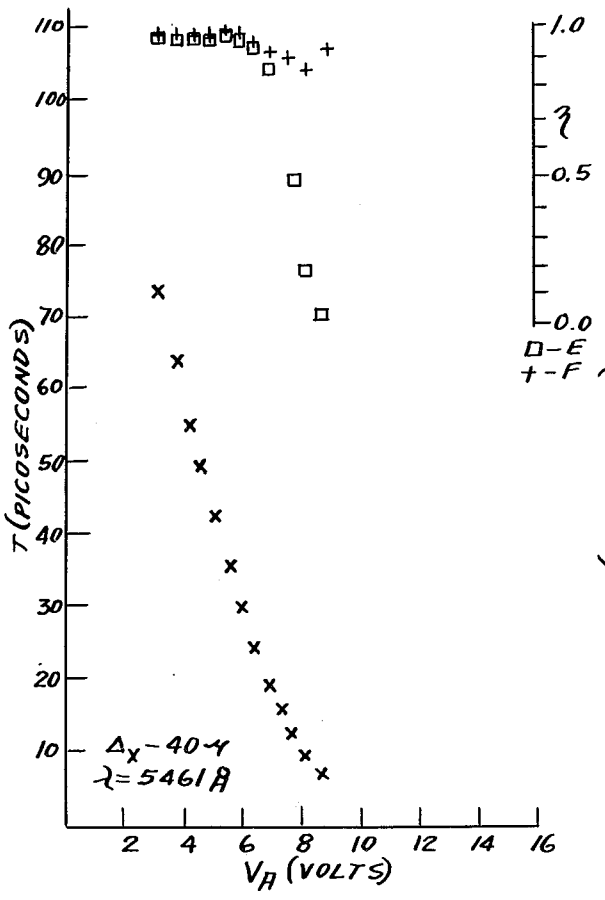
Figure 15A:
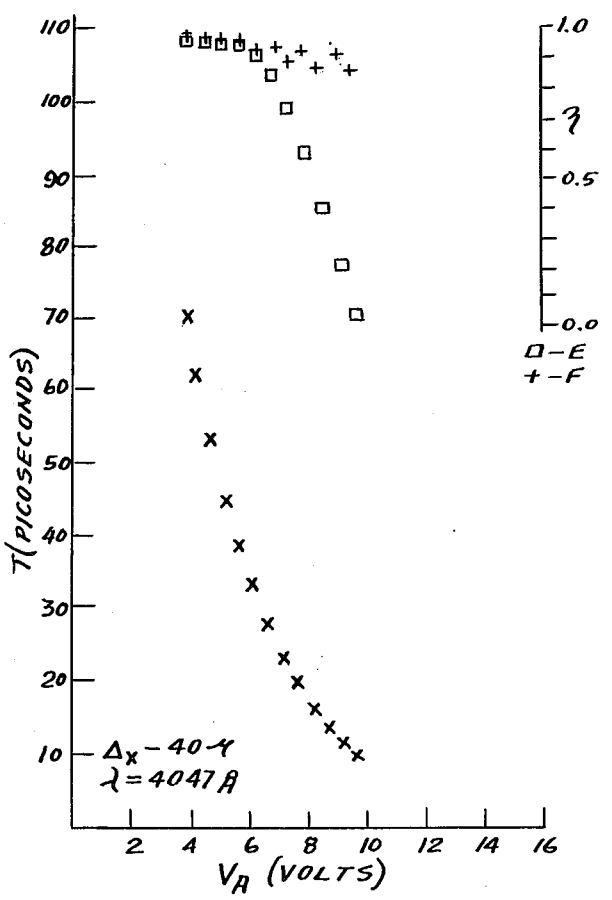
Figure 16C:
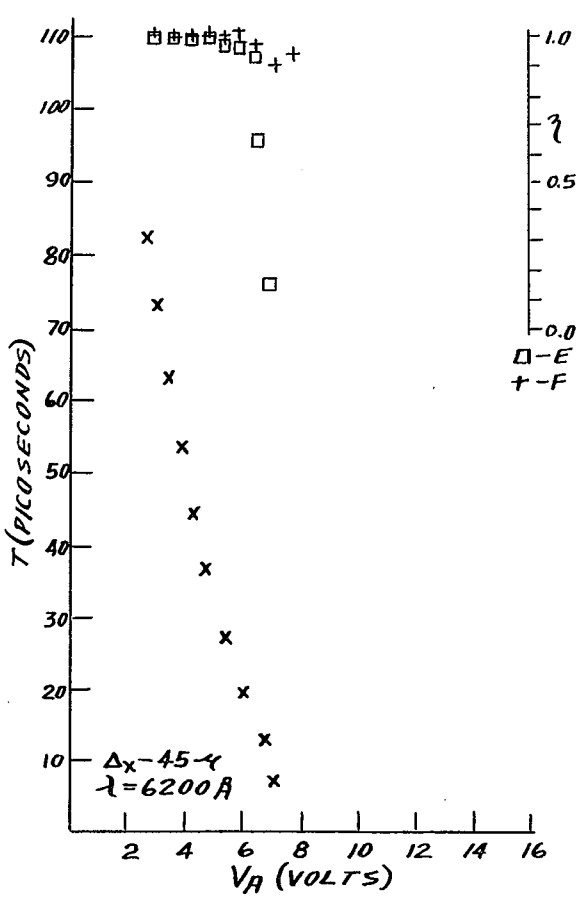
Figure 16B:
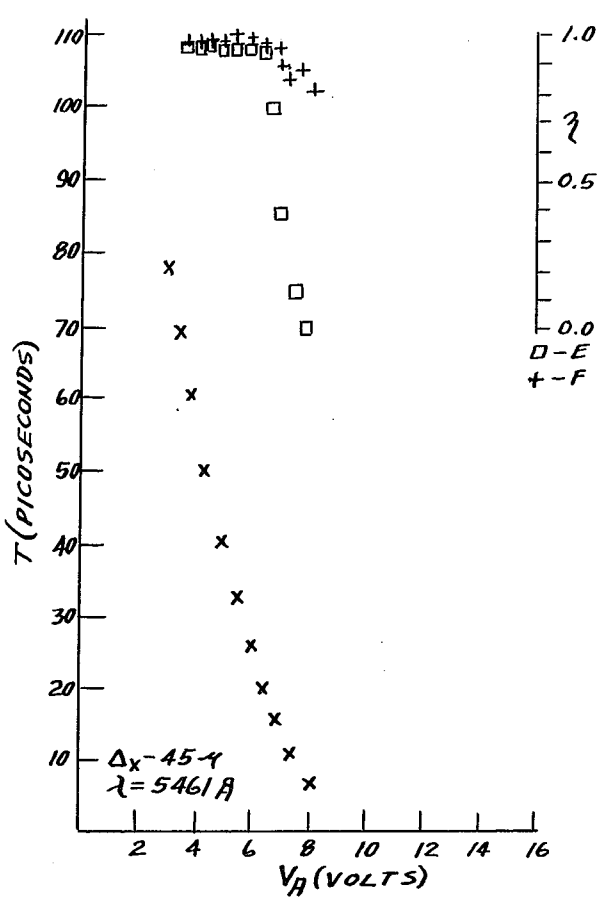
Figure 16A:
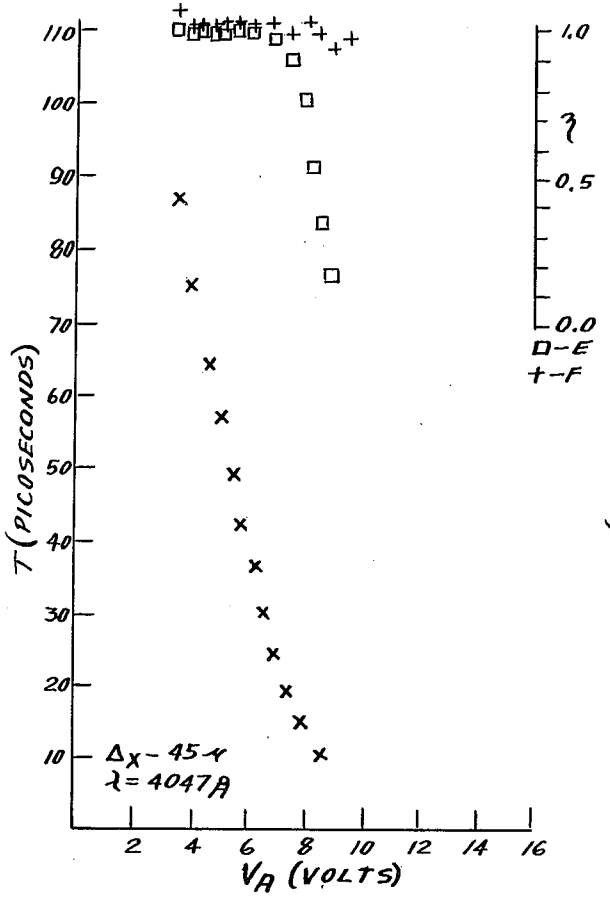
Figures 17A, 17B, 17C:
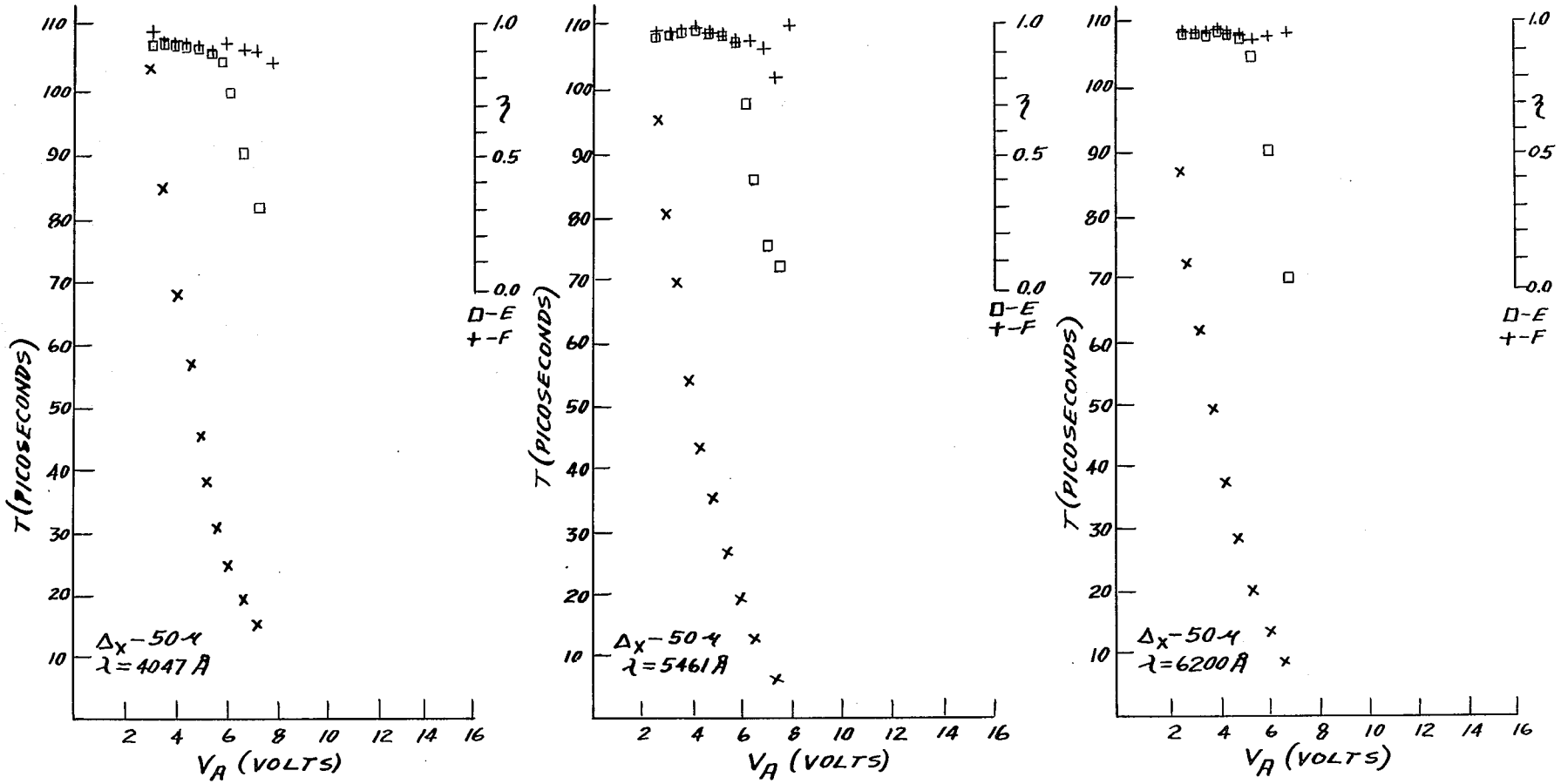

FIS. 13A–13C are curves corresponding to those of FIGS. 11A–11C, for drift spaces of 30 microns;

FIGS. 14A–14C are curves corresponding to those of FIGS. 11A–11C, for drift spaces of 35 microns;

FIGS. 15A–15C are curves corresponding to those of FIGS. 11A–11C for drift spaces of 40 microns;

FIGS. 16A–16C are curves corresponding to those of FIGS. 11A–11C for drift spaces of 45 microns;

FIGS. 17A–17C are curves corresponding to those of FIGS. 11A–11C for drift spaces of 50 microns.

Referring now to the drawings, and more in particular to FIGS. 1 and 2, an optoelectronic sampling head in accordance with the invention is comprised of a housing 20, for example of stainless steel. The housing 20 has parallel end faces 21 and 22, and a central preferably circular hole 23 extending between these faces. As shown in FIG. 2, a glass plate 24 is provided over the hole on the end face 21, and a glass plate 25 is provided over the hole 23 on the end face 22. The housing 20 and the glass plates define an enclosure which is evacuated, for example to about $10^{-8}$ Torr. Such a pressure maintains long life for the detector, and avoids spurious noise originating from ionization of residual gas constituents in the chamber. The plate 24 must be of a material transparent to the light to be detected. Thus, glass may be employed, unless the light to be detected is of ultraviolet wavelength, in which case such materials as quartz, sapphire, or lithium fluoride may be employed. A phosphor layer 26 is provided on the surface of the plate 25 within the chamber, the phosphor being employed to emit phosphorescent light. As will become evident in the following discussion, many phosphors are suitable for this purpose. If high efficiency is desired then phosphors like P-1, P-20, P-22 or P-31 can be selected;* if high rate of display is desired then P-36, P-37 or special materials like ZnO; Ga or CdS could be used. The plate 25 must be of a material transparent to the phosphorescent light from the phosphor layer 26, and may normally be comprised of a glass plate.

*Designations according to JEDEC

A pair of aligned holes 27 are provided extending through the side walls of the housing 20, and adapters 28 are sealed in these holes. For example, the adapters 28 may be brazed in position. The adapters 28 may be of stainless steel, and extend into the chamber to support a mesh support plate 29. The mesh support plate 29 may be comprised, for example of an Invar plate, and may be attached to the adapters 28 by any conventional means, such as screws 30. The top surface of the plate 29 is covered with a mesh 31, such as a gold mesh (which does not appear in FIG. 1), and the plate 29 has a central preferably elongated aperture 32. A photoemissive strip, such as gold strip 33, coated with cesium antimony (for example) is supported spaced from the mesh 31 over the aperture 32, for example, by means of a quartz plate 34 affixed to the plate 29. Suitable conductors 35 connect the ends of the strip to external terminals 36 by way of high frequency insulating seals 37.

Light entering the chamber by way of the window 24 may thus impinge on the gold photoemissive strip 33, and photoelectrons emitted from the photoemissive strip 33 pass through the gold mesh 31 and the aperture 32, and impinge on the phosphor layer 26, resulting in the emission of phosphorescent light which passes through the window 25.

The mounting of the gold strip 33 is more clearly illustrated in FIG. 3, wherein it is seen that the strip 33 is affixed by conventional means to the underside of a projection 40 from the quartz plate 34, so that the strip 33 is positioned above and spaced from the gold mesh 31 and aligned with the aperture 32. The aperture 32 may have beveled sides, as appears in FIG. 3. The gold mesh layer 31 is stretched on the top of the plate 29, and is thus positioned between the plate 29 and the quartz plate 34. The gold mesh is attached to the Invar plate by thermal binding. Due to the difference in expansion coefficients between gold and invar, this process binds and stretches the gold mesh. Further, as illustrated in FIG. 2, the plate 29 may be disposed at an acute angle to the axis of the hole 23 in the housing 20 so as to allow the light to be detected to strike the photoemissive strip either directly after passing through the window 24 or by first reflecting at the gold mesh.*

*The photoemissive strip could be made semitransparent (as many photocathodes are made) but must retain high electrical conductivity for the propagation of sampling pulses.

The adapters 28, as more clearly illustrated in FIGS. 4–6, are comprised of a tubular portion 41 adapted to pass through and be sealed in the holes 27 of the housing. The high frequency insulating feedthroughs are adapted to be sealed by conventional manner in the central holes 42 of the cylindrical portions 41. Semi-circular plates 43, coaxial with the cylindrical portions 41 are connected to the cylindrical portions 41 by arcuate sections 44. The semi-circular portions 43, cylindrical portions 41 and connecting portion 44 are shaped to take into consideration the required high frequency characteristics of the structure, with the plates 43 having arcuate recesses 45 coaxial with the cylindrical portions 41. The flat surfaces 46 of the portions 43 serve as mounting surfaces for the plate 29 of FIGS. 1 and 2.

The mounting plate 29 is more clearly illustrated in FIGS. 7–9, wherein it is seen that this plate may be generally square, with corner holes 48 for mounting the plate on the mounting surfaces of the adapters. In addition, mounting holes 49 may be provided for mounting the quartz plate 34.

In a typical embodiment, the plate 29 may be $\frac{3}{4}$ inch square, with a thickness of about 0.062 inches. The aperture 32 has a length of about 0.35 inches, and a width of about 0.125 inches. The hole 23 in the housing 20 has a diameter of about 1.375 inches. The sides of the aperture 32 and plate 29 extend at an angle of about 45° to the plane of the plate 29.

The gold strip 33 and gold mesh 31 are designed as elements of a microstrip system, that is, the mesh 31 is designed to serve as a microstrip ground plane for the strip 33. As a consequence, microwave sampling signals applied to the terminals 36 will propagate between the strip 33 and the mesh 31. The dimensions for these elements may be determined by employing conventional microstrip theory, as discussed in IRE transactions of the professional group on microwave theory and technique entitled "Symposium On Microwave Strip Circuits", March, 1955. The design of microstrip elements for optoelectronic sampling structures is also discussed in "Picosecond Optical Detection By High Speed Sampling of Photoelectrons", J. J. Wiczer and Henry Merkelo, Applied Physics Letters, Volume 27, No. 7, pages 397 et seq., Oct. 1, 1975, and in "Optoelectronic Sampling - 1. Parameters For Picosecond Resolution", Merkelo, Wiczer and Buttinger, submitted to IEEE Transactions on Electron Devices in 1975. While the strip 33 and mesh 31 have been disclosed as being of gold, it will be apparent that other materials may be employed for the strip 33, and other materials may be employed for the ground plane mesh 31.

The use of the optoelectronic sampling head of the invention is illustrated in simplified manner in FIG. 10, wherein a high speed sampling circuit, for example, a high speed pulse generator 50 is connected between the microstrip 33 and mesh ground plane 31 of the high speed optoelectronic sampling head 51 of FIGS. 1 and 2. A source 52 of retarding potential $V_r$ is also connected between these elements, with the negative terminal of a source being connected to the ground plane. The sampling head 51 is externally appended to a conventional photomultiplier tube 53, with the phosphor layer 26 of the head facing the photocathode 55 of the multiplier tube. A high voltage source 54 is connected between the ground plane 31 and the phosphor layer 26, with the positive terminal of the source 54 being connected to the phosphor layer 26.

The manner of employing the sampling head 51, as shown in FIG. 10, is illustrative only, and the application of potentials and pulses to the system is more completely described in U.S. Pat. No. 3,941,998. It should further be noted that the further considerations for the use and design of a high-speed sampling head, which are discussed in said copending application, are also valid for the system of the present invention. The high-speed sampling circuit 50 should, of course, generate sampling wave forms $v(t)$ which are of negative polarity, of short duration, and of amplitude such that effective sampling of photoelectrons created in the microstrip space, takes place.

In the design of a sampling photomultiplier, such as discussed in U.S. Pat. No. 3,941,998, the sampler electrodes constitutes the high-speed portion of the structure, and the electron multiplier tube forms the low frequency amplifier/integrator system. In the detachable sampling head structure of the present invention, the phosphor layer 26, and the associated electrodes, perform the low frequency function. As a consequence, this portion of the structure did not have "high speed" or broad band characteristics. It is therefore not necessary to employ a "high speed" photomultiplier in combination with the sampling head of the present invention, and the sampling head of the invention may be employed to improve the time resolution of a conventional multiplier that is not designed for such "high speed" use.

Unlike in many static or quasi-static devices in which the response-time of the phosphor plays no importance, the phosphorescence time constant of the material suitable for optoelectronic sampling must correspond to the desired display frequency-range. Significantly, the speed of the phosphor does not influence the resolution time (or the rise-time) of the sampling head unless the display frequency exceeds the designed frequency-range leading to the overlapping of displayed signals. This characteristic occurs by virtue of the integrator role of the phosphor. There is, however, no lower limit on the luminescence decay time of the phosphor. In the event of extremely rapid phosphorescence decays, the integrator function of the phosphor can be designed into, and assigned to the elements ancillary to the sampling head, for example, image intensifier, photomultiplier, display coupling circuit, etc., all standard in design. These considerations can be expressed approximately by the requirement $\tau_{PH} < T_D$ where $\tau_{PH}$ is the phosphorescence decay time and $T_D$ is the period of the display-frequency. For an overall low noise performance but particularly in the case of ultra-high-time resolution work and picosecond resolution photon counting, it is important that a high efficiency phosphor is used and that it is excited with optimum photoelectron energies.

As a result, it is apparent that the phosphor of the layer 26 of the sampling head of the present invention may be selected in accordance with the desired high frequency characteristics, and that the sampling head may thus be employed in combination with a conventional photomultiplier not designed for such high frequency detection in order to improve the resolution of the conventional device. As a consequence, the present invention enables picosecond time resolution of optical signals with ordinary commercial phototubes.

FIGS. 11–17 are curves illustrating the dependence of sampling resolution time $\tau$ and sampling efficiency $\eta$ of the detachable sampling head of the invention as a function of the retarding potential $V_r$, for spacings $\Delta_x$ between the microstrip 33 and ground plane 31 ranging from 10 to 50 microns, with each of these figures illustrating the results of tests for three optical wavelengths of 4047, 5461 and 6200 angstrom units of light to be detected. In each of these samples, the photoemissive strip 33, or photocathode was of cesium antimony, and the sampling waveforms $\nu((t)$ correspond to:

$$\nu(t) = \begin{cases} O & \text{for } t \leq O \\ V_o \sin^2 \frac{(\pi\, t)}{\Gamma} & \text{for } O \leqq t \leqq \Gamma \\ O & \text{for } t > \Gamma \end{cases}$$

where the amplitude $V_o = 14.2$ V and $\tau = 68$ picoseconds. Other operating wavelengths, other photoactive materials and other sampling waveforms will result in different curves. These curves, however, can be obtained from the same theory. For each value of $\Delta_x$ there corresponds a unique value for the width of the photoactive strip, given that the impedance of the sampling microstrip is specified.

Frequently, in real devices, the sampling function $f_s(t)$ will not reach the peak value $S_o$. In general, $f_s(t)$ is not a rectangular waveform and, in addition, its shape changes with parameters such as $V_r$, $\Delta_x$, and $\lambda$. The two quality parameters, $\eta_E$ and $\eta_F$, designating sampling efficiency and sampling fidelity, respectively, are defined and computed on the basis of the following relations:

$$\eta_E = \frac{1}{S_o \tau} \int_{t_o}^{t_o + \tau} f_s(t)\, dt \tag{10}$$

$$\eta_F = \frac{\int_{t_o}^{t_o + \tau} f_s(t)\, dt}{\int_{(n-1)T}^{nT} f_s(t)\, dt} \tag{11}$$

where, as illustrated in FIG. 5, $S_o$ is the theoretical maximum of the sampling function $f_s(t)$; S, the actual maximum of $f_s(t)$; and, $t_o$ and $\tau$ are such that $f_s(t_o) = f_s(t_o + \tau) = S/2$. The sampling efficiency parameter $n_E$ thus quantifies the effectiveness of the sampling fields in extracting (from the drift space $\Delta_x$) photoelectrons created within the time interval $\tau$. Thus, $\eta_E$ relates to signal strength. The need for defining the sampling fidelity parameter $\eta_F$ arises from the fact that, for any given sampling waveform $\nu(t)$, the analytical form of $f_s(t)$ changes for different parameters.

While the invention has been disclosed and described with reference to a single embodiment, it will be apparent that variations and modifications may be made therein. Thus, other support structures may be employed for the microstrip and ground plane, and other broad band feedthroughs may be employed for the microstrip drive, as long as the electrical insulating requirements and sealing properties that are required for an ultra-high vacuum chamber are met. It is therefore intended in the following claims to cover each such variation and modification as falls within the true spirit and scope of the invention.

What is claimed is:

1. A high-speed optoelectronic sampling head comprising a detachable housing for use with a photo amplifying device, said housing defining an evacuated chamber, a photoemissive strip fixedly mounted in said chamber, a ground plane fixedly mounted in said chamber spaced from said photoemissive strip and defining a microstrip ground plane for said photoemissive strip, feedthrough means extending through a wall of said housing for propagating a high-speed sampling potential difference between said photoemissive strip and said ground plane, a phosphor layer in said chamber positioned to receive photoelectrons emitted from said photoemissive strip, said housing having a first window positioned to direct light to be detected to said photoemissive strip, and a second window transparent to phosphorescent light from said phosphor layer for directing said phosphorescent light from said chamber externally of said housing.

2. The high-speed optoelectronic sampling head of claim 1, wherein said housing comprises an opaque member having a hole extending therethrough between first and second parallel end faces and defining the walls of said chamber, said first and second windows comprising transparent light sealed over the end faces of said opaque member, and wherein said phosphor layer comprises a phosphor layer on said second window in said chamber.

3. The high-speed optoelectronic sampling head of claim 2, wherein said windows are of glass and said opaque member is of stainless steel.

4. The high-speed optoelectronic sampling head of claim 1, wherein said feedthrough means comprises adapter means fitted in the side walls of said housing and extending into said chamber, said ground plane being mounted on said adapter means in said housing, said adapter means defining holes communicating between said chamber and the outside of said housing, and means extending through said adapter means for electrically connecting said photoemissive strip externally of said housing.

5. A high-speed optoelectronic sampling head comprising a detachable housing for use with a photo amplifying device, said housing member having a hole extending between first and second faces, a transparent window at each end of said hole sealed to said housing, for defining an evacuated chamber in said housing, first and second mounting holes aligned with each other and extending through opposite sides of said housing normal to the axis of said first-mentioned hole, adapter means sealed in said mounting holes and extending into said chamber, a microstrip ground plane mounted on said adapter means in said chamber, means mounting a photoemissive strip adjacent said ground plane in said chamber, whereby said photoemissive strip comprises a microstrip, said microstrip being positioned to receive light to be detected from said first window, means propagating an electropotential between said photoemissive strip and said ground plane, a phosphor layer on said second window in said chamber, said photoemissive strip being positioned to direct photoelectrons emitted therefrom through said ground plane to said phosphor layer.

6. The high-speed optoelectronic sampling head of claim 5, wherein said ground plane comprises a metallic mesh.

7. The optoelectronic sampling head of claim 5, comprising a mounting plate mounted on said adapter means, said ground plane comprising a metallic mesh stretched on said mounting plate, said mounting plate having an aperture extending therethrough, said photoemissive strip being positioned to direct photoelectrons emitted therefrom through said mesh and aperture in that order to said phosphor layer.

8. A high-speed optoelectronic sampling head comprising a detachable housing for use with a photo amplifying device, said housing defining an evacuated chamber having first and second transparent windows, a conductive mesh supported in said chamber, a photoemissive strip positioned in said chamber spaced from said mesh whereby light to be detected passes through said first window and falls upon said photoemissive strip to result in the production of photoelectrons, a phosphor layer on said second window in said chamber, said phosphor layer positioned to receive photoelectrons from said photoemissive strip passing through said mesh, and high-frequency insulating means in the wall of said housing for applying sampling potential between said photoemissive strip and said mesh, said photoemissive strip comprising a microstrip and said mesh comprising a ground plane for said microstrip, whereby said sampling potential propagates between said photoemissive strip and mesh.

9. The high-speed optoelectronic sampling head of claim 8, comprising a conductive mounting plate for said mesh, said mounting plate having an aperture extending therethrough, said mesh being stretched on said mounting plate over said aperture.

10. The high-speed optoelectronic sampling head of claim 9, comprising conductive adapter means affixed in a wall of said housing for supporting said support plate, said adapter means having hole means extending therethrough, and high-frequency insulating means in said hole means for connecting said photoemissive strip externally of said housing.

11. The high-speed optoelectronic sampling head of claim 10, comprising a quartz plate mounted to said support plate, said photoemissive strip being supported on said quartz plate.

* * * * *

UNITED STATES PATENT AND TRADEMARK OFFICE

CERTIFICATE OF CORRECTION

PATENT NO. : 4,069,418

DATED : January 17, 1978

INVENTOR(S) : Henry Merkelo

It is certified that error appears in the above-identified patent and that said Letters Patent are hereby corrected as shown below:

Column 1, line 65 change "need" to --needs--.

Column 1, line 67 change "not" to --now--.

Column 4, line 55 change "copending application" to --patent--.

Column 7, line 11 change "comprises" to --comprise--.

Signed and Sealed this

Sixteenth Day of May 1978

[SEAL]

*Attest:*

RUTH C. MASON
*Attesting Officer*

LUTRELLE F. PARKER
*Acting Commissioner of Patents and Trademarks*